US006067822A

United States Patent [19]

Heinzel et al.

[11] Patent Number: 6,067,822

[45] Date of Patent: May 30, 2000

[54] CONCRETE RING AS A BALANCING WEIGHT AT A WASHING SOLUTION CONTAINER OF A WASHING MACHINE

[75] Inventors: Lothar Heinzel; Lorenz Claussen, both of Berlin, Germany

[73] Assignee: BSH Bosch und Siemens Hausgeraete GmbH, Munich, Germany

[21] Appl. No.: 09/162,798

[22] Filed: Sep. 29, 1998

[30] Foreign Application Priority Data

Sep. 29, 1997 [DE] Germany ..... 197 42 983

[51] Int. Cl.[7] ..... D06F 37/22

[52] U.S. Cl. ..... 68/23.2

[58] Field of Search ..... 68/23.2; 210/144, 210/363, 364; 494/82; 74/573 R

[56] References Cited

U.S. PATENT DOCUMENTS 4,250,724 2/1981 Altnau ..... 68/23.2

5,893,281 4/1999 Teich ..... 68/23.2 X

FOREIGN PATENT DOCUMENTS 0623436 11/1994 European Pat. Off. ..... 68/23.2

90 15 420 11/1990 Germany ..... 68/23.2

2044298 10/1980 United Kingdom ..... 68/23.2

*Primary Examiner*—Philip R. Coe

*Attorney, Agent, or Firm*—Herbert L. Lerner; Laurence A. Greenberg; Werner H. Stemer

[57] ABSTRACT

A concrete ring as a balancing weight for a washing solution container of a washing machine includes a ring part which is U-shaped in cross-section, open at one side and filled out with a mass containing concrete. The outer periphery of the ring part has a connecting device to be connected with the washing solution container. This structure makes a continuous production of the concrete ring possible.

13 Claims, 2 Drawing Sheets

CONCRETE RING AS A BALANCING WEIGHT AT A WASHING SOLUTION CONTAINER OF A WASHING MACHINE

BACKGROUND OF THE INVENTION

Field of the Invention

The invention relates to a concrete ring as a balancing weight for a washing solution container of a washing machine.

Such a concrete ring is known from German Published, Non-Prosecuted Patent Application DE 32 17 160 A1. The known concrete ring is provided with a hoop which is tightened around it at its outer surface and at which in addition an outer collar is formed thereon at an angle. The outer collar is connectible through the use of a clamping ring with an outer collar disposed at the washing solution container of the washing machine.

During the manufacture of such a concrete ring, it must be cast in an appropriate special mould and can only be released from the mould after a specific hardening time. A plurality of casting moulds is thereby occupied during the hardening time, so that in the case of large production batches a correspondingly number of casting moulds are required or else it is always necessary to wait out the hardening time until freeing of the casting moulds, making a continuous production difficult. Moreover, the moulds filled with concrete have to be deposited at a suitable storage place during the hardening time, which requires a correspondingly large storage area.

SUMMARY OF THE INVENTION

It is accordingly an object of the invention to provide a concrete ring as a balancing weight at a washing solution container of a washing machine, which overcomes the hereinafore-mentioned disadvantages of the heretofore-known devices of this general type and which makes a continuous production of the concrete ring possible.

With the objects of the invention in view there is also provided a concrete ring as a balancing weight for a washing solution container of a washing machine, comprising a ring part having a U-shaped cross-section, one open side and an outer periphery, the ring part filled out by a mass containing concrete; and a connecting device disposed at the outer periphery of the ring part for connection to a washing solution container.

Since the ring part remains at the concrete ring, a hardening time no longer has to be waited out. The required concrete rings can be cast continuously.

In accordance with another feature of the invention, the fastening of the concrete ring to the washing solution container is made possible in simple manner by constructing the connecting device as a radially outwardly facing connecting flange. The concrete ring can be connected with the washing solution container through the use of this connecting flange either by a screw connection or by a clamping ring placed over the outer periphery of the connecting flange and the outer periphery of a similar connecting flange provided at the washing solution container.

In accordance with a further feature of the invention, a reinforcing part required for the strength of the concrete ring can be introduced into the concrete ring in simple manner in such a way that one or more sockets carrying reinforcing parts are inserted into the space between the two U-limbs of the ring part. In that case it is advantageous if the sockets are integrally formed thereon at the base of the U-shaped ring part.

In accordance with an added feature of the invention, a sufficient retention of the reinforcing parts during the casting of the concrete ring is achieved by providing the sockets at their free ends with one or more receiving openings for the reinforcing part or parts.

In accordance with an additional feature of the invention, the strength of the wall part of the U-shaped ring part is increased by providing support webs at respective outer surfaces of the U-limbs of the ring part.

In accordance with yet another feature of the invention, the area required for the storage necessary for the hardening of the concrete rings can be considerably reduced by providing that the U-shaped ring part is stackable.

In accordance with yet a further feature of the invention, a stable stacking of the concrete rings is achieved by forming bead-shaped depressions at the free edges of the U-limbs of the ring part and forming protrusions lying at the height of the diameter of the U-limbs of the ring part corresponding to the shape of the bead-shaped depressions at the outer surface of the base of the ring part.

In accordance with yet an added feature of the invention, a filling out with concrete of the U-shaped ring parts previously stacked one above the other in the unfilled state is made possible by providing a pouring opening at least at one of the U-limbs of the ring part.

In accordance with yet an additional feature of the invention, there are provided undercuts and/or retaining straps at the inner surface of the U-limbs and/or the base of the U-shaped ring part. A firm and non-detachable connection between the U-shaped ring part and the concrete ring is achieved thereby.

In accordance with again another feature of the invention, in the case of a front-loading washing machine, the U-shaped ring part can be constructed as an end wall closing the washing solution container. Thus, the otherwise conventional end wall of the washing solution container may be omitted.

In accordance with a concomitant feature of the invention, in that case the annular base of the ring part extends beyond the inner U-limbs to the center of the ring part and surrounds the loading-in opening of the washing machine.

Other features which are considered as characteristic for the invention are set forth in the appended claims.

Although the invention is illustrated and described herein as embodied in a concrete ring as a balancing weight at a washing solution container of a washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
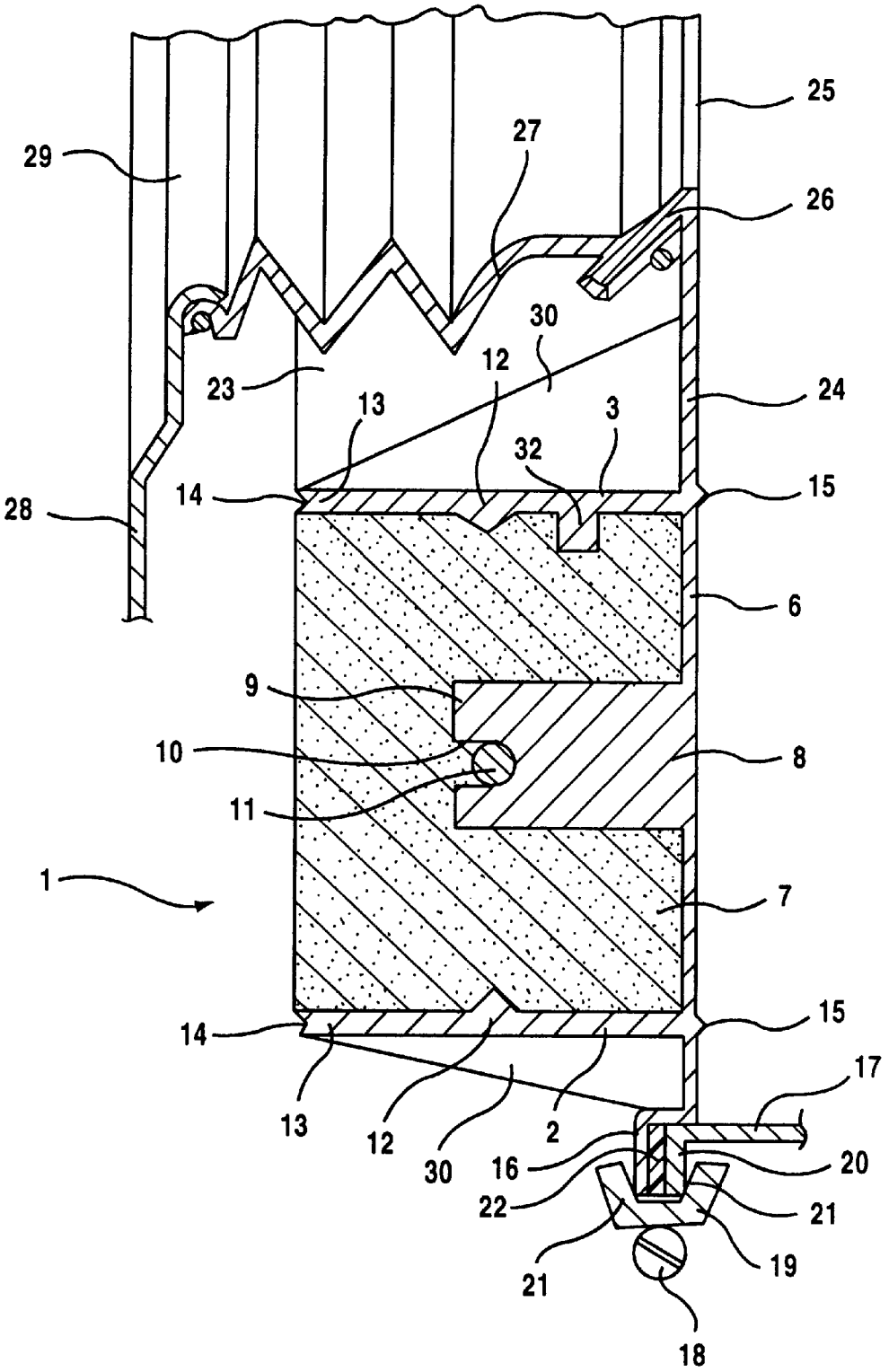
FIG. 1 is a fragmentary, diagrammatic, in half-sectional view of a ring part which is U-shaped in cross-section and filled with concrete.
Figure 3:
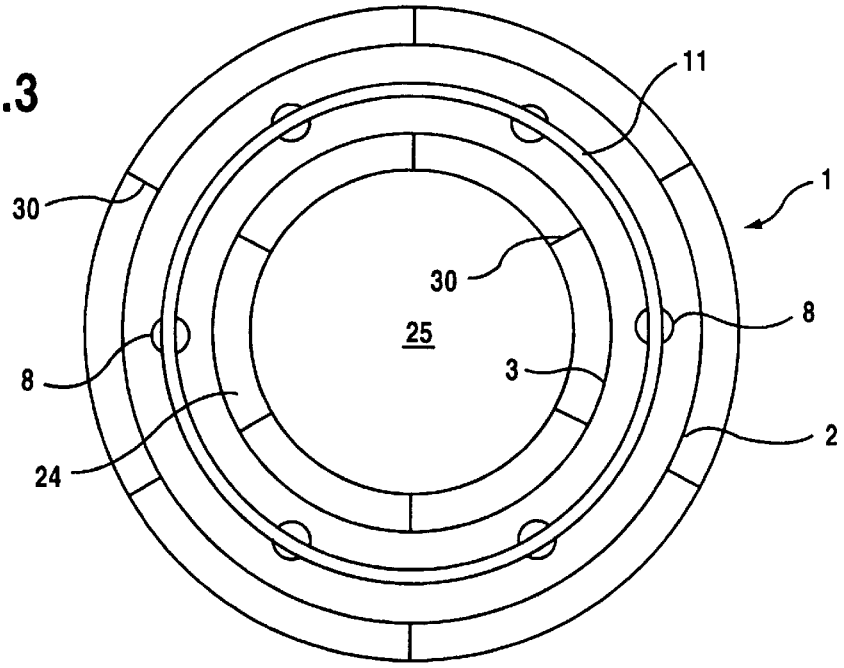
FIG. 3 is a plan view of a ring part which is U-shaped in cross-section and not yet filled with concrete.

Referring now to the Figures of the drawings in detail and first, particularly, to FIGS. 1 and 3 thereof, there is seen a ring part 1 which is constructed to be U-shaped in its cross-section. Two U-limbs 2 and 3 form an outer and an inner peripheral wall, which form an annular chamber together with a base 6 of the U-shaped ring part 1. This annular chamber is filled out with a mixture, in which concrete is contained and which forms a concrete ring 7 after hardening. Several sockets 8 protruding into the annular chamber between the U-limbs 2 and 3 formed integrally at the base 6 are provided to be distributed around the periphery of the U-shaped ring part 1. The sockets 8 have free ends 9 at which a receiving opening 10 for a reinforcing ring 11 is formed. This reinforcing ring 11 is inserted into the receiving opening 10 of the sockets 8 before the filling out of the U-shaped ring part 1, so that it is surrounded by the casting mass during filling out of the U-shaped ring part 1 and imparts a higher strength to the concrete casting ring 7 after hardening thereof.

Support ribs 30 are disposed at outer surfaces of the U-limbs 2 and 3 in order to sufficiently support the U-limbs 2 and 3 against pressure acting thereon during filling in of the casting mass. Projections 12, which axially secure the concrete ring in the ring part 1 and form undercuts, are formed at inner surfaces of the U-limbs 2 and 3, although retaining straps 32 could be used.

Figure 2:
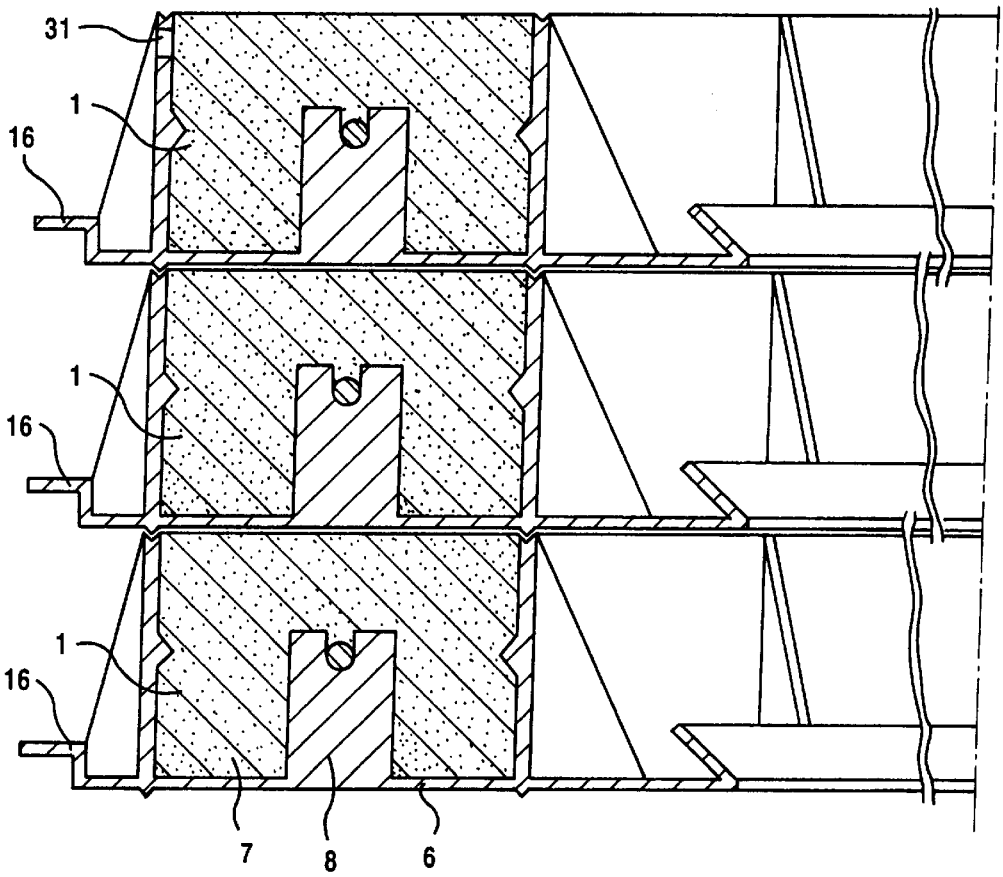
FIG. 2 is a half-sectional view of several ring parts which are U-shaped in cross-section and stacked one above the other.

According to FIG. 2 the ring parts 1 can be stacked one above the other. The stacking can take place before or after the filling out of the annular chambers of the ring parts 1. A pouring-in opening 31 is provided at one or more locations of the outer and/or inner U-limbs 2 and 3 in order to be able to stack the ring parts 1 unfilled. The casting mass can be introduced into the annular chamber in the stacked state of the U-shaped ring parts 1 by way of this pouring-in opening.

Respective bead-shaped depressions 14 are impressed at free edges 13 of the U-limbs 2 and 3 in order to increase stack rigidity. Protrusions 15 lying at the height of the diameter of the U-limbs 2 and 3 are formed on at an outer surface of the base 6 opposite the depressions. During stacking of the ring parts 1 one on the other, these protrusions respectively engage in the bead-shaped depressions 14 of the ring part 1 lying thereunder and thus secure the U-shaped ring parts 1 stacked one on the other against slipping.

The ring parts 1 form so-called lost casting moulds and separate, reusable casting moulds are accordingly superfluous. Therefore even during casting of the individual concrete rings 7 it is not necessary to wait out a hardening time in order to have the casting mould available again. Due to the stackability of the ring parts 1, a considerably smaller storage area is needed for storage which is necessary for hardening of the cast concrete rings 7 of the ring parts 1. This also applies to a possible stocking of the concrete rings 7.

A connecting device in the form of a radially outwardly facing connecting flange 16 is furthermore formed on at the ring part 1. The ring part 1 can be fastened to a washing solution container 17 of a washing machine through the use of this connecting flange 16. One possible mode of fastening is indicated in FIG. 1. In that case, a clamping ring 19 tightenable through the use of a screw 18 is placed around the outer periphery of the connecting flange 16 of the washing similarly constructed connecting flange 20 of the washing solution container 17. The clamping ring 19 has obliquely extending sides 21, so that upon tightening of the clamping ring 19, the two connecting flanges 16 and 20 are axially pressed against one another by the sides 21.

In the case of the embodiment illustrated in FIG. 1, the ring part 1 is constructed overall in such a way that with a front-loading washing machine it takes over the function of a front end wall of the washing solution container 17. For this reason, a sealing element 22 is inserted between the two connecting flanges 16 and 20. Upon tightening of the clamping ring 19, the connecting flanges 16 and 20 are pressed against this sealing element 22, so that the washing solution container 17 is sufficiently sealed at its end surface.

Furthermore, a wall part 24 extending radially into a space 23 bounded by the inner U-limb 3, is formed on at the U-shaped ring part 1. This wall part 24 has a middle region formed as a loading-in opening 25. An obliquely rising flange 26 extends out from the edge of this opening 25. A sealing sleeve 27, which is fastened to the flange 26 in a known manner, produces a connection to a loading-in opening 29 provided at a housing 28 of the washing machine.

In this variant embodiment, the U-shaped ring part 1 is at the location of an otherwise required end wall of the washing solution container 17. The end wall of the washing solution container 17 and the balancing weight are therefore integrally connected together.

We claim:

1. A concrete ring as a balancing weight for a washing solution container of a washing machine, comprising:

a ring part having a U-shaped cross-section, one open side and an outer periphery, said ring filled out by a mass containing concrete, said ring part having U-limbs with free edges and a diameter with a given height, said ring part having a base with an outer surface, said free edges having bead-shaped depressions formed therein with a given shape, and said outer surface of said base having protrusions formed thereon at said given height and corresponding to said given shape; and a connecting device disposed at said outer periphery of said ring part for connection to a washing solution container.

2. The concrete ring according to claim 1, wherein said connecting device is a radially outwardly facing connecting flange.

3. The concrete ring according to claim 1, wherein said ring part has two U-limbs, and at least one socket carrying at least one reinforcing part is inserted between said two U-limbs.

4. The concrete ring according to claim 3, wherein said ring part has a base, and said at least one socket is integrally formed on at said base.

5. The concrete ring according to claim 4, wherein said at least one socket has a free end with at least one receiving opening for said at least one reinforcing part.

6. The concrete ring according to claim 1, wherein said ring part has U-limbs with outer surfaces and support webs each disposed at a respective one of said outer surfaces.

7. The concrete ring according to claim 1, wherein said U-shaped ring part is stackable with other ring parts.

8. The concrete ring according to claim 1, wherein at least one of said U-limbs has a pouring-in opening.

9. The concrete ring according to claim 1, wherein said ring part has U-limbs with inner surfaces and a base with a surface, at least one of said surfaces having undercuts.

10. The concrete ring according to claim 1, wherein said ring part has U-limbs with inner surfaces and a base with a surface, at least one of said surfaces having retaining straps.

11. The concrete ring according to claim 10, wherein said ring part has an inner U-limb, an outer U-limb, an annular base and a center, and said annular base extends beyond said inner U-limb to said center and surrounds a loading-in opening of the washing machine.

12. The concrete ring according to claim 1, wherein said ring part has U-limbs with inner surfaces and a base with a surface, at least one of said surfaces having undercuts and retaining straps.

13. The concrete ring according to claim 1, wherein said U-shaped ring part is an end wall closing the washing solution container for a front-loading washing machine.

* * * * *